US005135420A

United States Patent [19]

Sumi et al.

[11] Patent Number: 5,135,420

[45] Date of Patent: Aug. 4, 1992

[54] PROCESS FOR MANUFACTURING CATHODE RAY TUBE

[75] Inventors: Kazuhiko Sumi; Hiroshi Kanoh; Yasunori Niwa, all of Aichi, Japan

[73] Assignee: Sony Corporation, Tokyo, Japan

[21] Appl. No.: 760,537

[22] Filed: Sep. 16, 1991

[30] Foreign Application Priority Data

Sep. 20, 1990 [JP] Japan ..... 2-251346

[51] Int. Cl.[5] ..... B08B 7/00

[52] U.S. Cl. ..... 445/59; 134/18; 134/22.18; 427/352

[58] Field of Search ..... 445/59; 427/68, 352, 427/354; 134/22.18, 18

[56] References Cited

U.S. PATENT DOCUMENTS 3,473,942 10/1969 Magill et al. ..... 427/68 X 3,638,275 2/1972 Larson ..... 445/59

4,463,075 7/1984 Fritsch ..... 427/68 X 4,685,975 8/1987 Kottman et al. ..... 134/33

*Primary Examiner*—Kenneth J. Ramsey

*Attorney, Agent, or Firm*—Hill, Van Santen, Steadman & Simpson

[57] ABSTRACT

A process of manufacturing a cathode ray tube wherein trimming cleaning of an inner wall of a skirt portion of a panel is performed in a non-contacting condition to prevent splashing of water and trimming cleaning of panels of different sizes can be performed. A rotational position signal is detected in response to rotation of a panel, and while the distance between a cleaning nozzle and an inner wall of a skirt portion of the panel is kept constant in response to such rotational position signal, cleaning liquid is supplied through the cleaning nozzle to clean the inner wall of the skirt portion of the panel.

7 Claims, 4 Drawing Sheets $d_a = 0$ (REFERENCE)

$d_b = L_B - L_A$ $d_c = L_C - L_B$

⋮

PROCESS FOR MANUFACTURING CATHODE RAY TUBE

BACKGROUND OF THE INVENTION

1. Field of the Invention

This invention relates to a process of manufacturing a cathode ray tube, and more particularly to a method of trimming cleaning a cathode ray tube to remove slurry of a fluorescent material and so forth from an inner wall of a skirt portion of a panel of the cathode ray tube.

2. Description of the Prior Art

Conventionally, at a step of forming a fluorescent face on an inner face of a panel in a process of manufacturing a cathode ray tube, slurry of a blue fluorescent material is first applied to an inner wall of a panel, and then the panel is trimming cleaned using, for example, water to removed such fluorescent material slurry sticking to an inner wall of a skirt portion of the panel (water processing step).

According to such coventional water processing method, a panel is rotated around its axis at a speed of, for example, 5 rpm or so, and a roller is pressed against an outer periphery of the thus rotating panel to trimming clean an inner wall of a skirt portion of the panel using a cleaning nozzle secured to a known link mechanism.

In other words, the conventional method is a water processing method relying upon tracing of an outer profile of a panel. Thus, for example, an offset between an axis of a roller and an inner wall of a skirt portion of a panel is detected, and a link mechanism is moved up or down mechanically in response to such offset so that a cleaning nozzle may be kept at a fixed distance from the inner wall of the skirt portion of the panel while cleaning liquid is supplied from a cleaning nozzle to trimming clean the inner wall of the skirt portion.

With the conventional water processing method, however, since the roller is contacted with an outer periphery of the panel to trimming clean the inner wall of the skirt portion of the panel tracing the profile of the outer periphery of the panel, if there is some irregularity in profile of the outer periphery of the panel or in rotation of the panel around its axis, then vibration will take place with the roller. Scuh vibration may be transmitted to the cleaning nozzle by way of the link mechanism to cause so-called splashing of water, which leads to incomplete formation of a fluorescent face or to incomplete accomplishment of some other manufacturing step of the panel or the like. resulting in remarkable deterioration in yield and quality of cathode ray tube products.

Further, when it is tried to apply such conventional water processing method to cleaning of a cathode ray tube having a comparatively high aspect ratio such as, for example, a high definition cathode ray tube, the link mechanism will be insufficient in stroke and will not assure a sufficient strength. Besides, the offset described above will be so great that the link mechanism cannot trace the profile of the outer periphery of the panel to accurately follow a predetermined pouring locus of the cleaning nozzle. Consequently, the conventional water processing method cannot cope well with a high definition cathode ray tube.

SUMMARY OF THE INVENTION

It is an object of the present invention to provide a process of manufacturing a cathode ray tube wherein trimming cleaning of an inner wall of a skirt portion of a panel is performed in a non-contacting condition.

It is another object of the present invention to provide a process of manufacturing a cathode ray tube by which splashing of water can be prevented and trimming cleaning of panels of different sizes can be performed.

It is a futher object of the present invention to provide a process of manufacturing a cathode ray tube which can assure a high yield and a high quality of cathode ray tube products.

In order to attain the objects, according to an aspect of the present invention, there is provided a process of manufacturing a cathode ray tube, wherein a rotational position signal is detected in response to rotation of a panel, and while the distance between a cleaning nozzle and an inner wall of a skirt portion of the panel is kept constant in reponse to such rotational position signal, cleanig liquid is supplied through the cleaning nozzle to clean the inner wall of the skirt portion of the panel.

With the process, since the position of the cleaning nozzle is set in response to a rotational position signal which is detected in response to rotation of a panel, trimming cleaning of an inner wall of a skirt portion of the panel can be peformed in a non-contacting condition. Accordingly, trimming cleaning can be performed without being influenced by irregularity in profile of an outer periphery of the panel or in rotation of the panel, and splashing of cleaning liquid which may be caused by vibrations of the cleaning nozzle or the like can be prevented, which result in high yield and high quality of cathode ray tube products.

Further, since the position of the cleaning nozzle is set in response to a rotational position signal, such position can be controlled readily for different pannels of different sizes comparing with such conventional process wherein such position is set mechanically relying upon contacting tracing of a roller by means of a link mechanism as described herein above. Consequently, cathode ray tubes having a comparatively high aspect ratio or ratios and cathode ray tubes having panels of different sizes can be processed or trimming cleaned successively.

Accordingly to another aspect of the present invention, there is provided a method of cleaning a panel in manufacture of a cathode ray tube, comprising the steps of producing, for each angular rotation of a predetermined angle of a panel of a particular type around a fixed axis, distance data of a inner wall of the panel and storing the distance data successively into a memory for one full rotation of the panel, rotating a panel of the particular type around the fixed axis, and supplying cleaning liquid through a cleaning nozzle to an inner wall of a skirt portion of the panel being rotated while maintaining the distance between the cleaning nozzle and the inner wall of the skirt portion of the panel constant in response to distance data read out from the memory in response to an angular position of the panel.

According to a further aspect of the present invention, there is provided a apparatus for cleaning a panel in manufacture of a cathode ray tube, which comprises panel rotating means for removably receiving a panel and rotating the same around a fixed axis, a cleaning nozzle for supplying cleaning liquid to an inner wall of a skirt portion of a panel being rotated by the panel rotating means, nozzle moving means for moving the cleaning nozzle along a particular straight line passing the fixed axis, means for detecting a rotational position signal in response to rotation of a panel received on the panel rotating means, distance data producing means for producing distance data each time a panel received on the panel rotating means is rotated by a predetermined angle, storage means for storing therein distance data successively produced from the distance data producing means for one full rotation of a panel received on the panel rotating means, the distance data being stored for a particular type of the panel, means for reading out the distance data for the particular type from the storage means in response to an angular position of a panel received on and being rotated by the panel rotating means, and controlling means for controlling the nozzle moving means to keep the cleaning nozzle, in response to the distance data read out from the storage means, at a predetermined distance along the particular straight line from the inner wall of the skirt portion of a panel of the particular type being rotated by the panel rotating means.

The above and other objects, features and advantages of the present invention will become apparent from the following description and the appended claims, taken in conjunction with the accompanying drawings.

DETAILED DESCRIPTION OF THE PREFERRED EMBODIMENT

Figure 1:
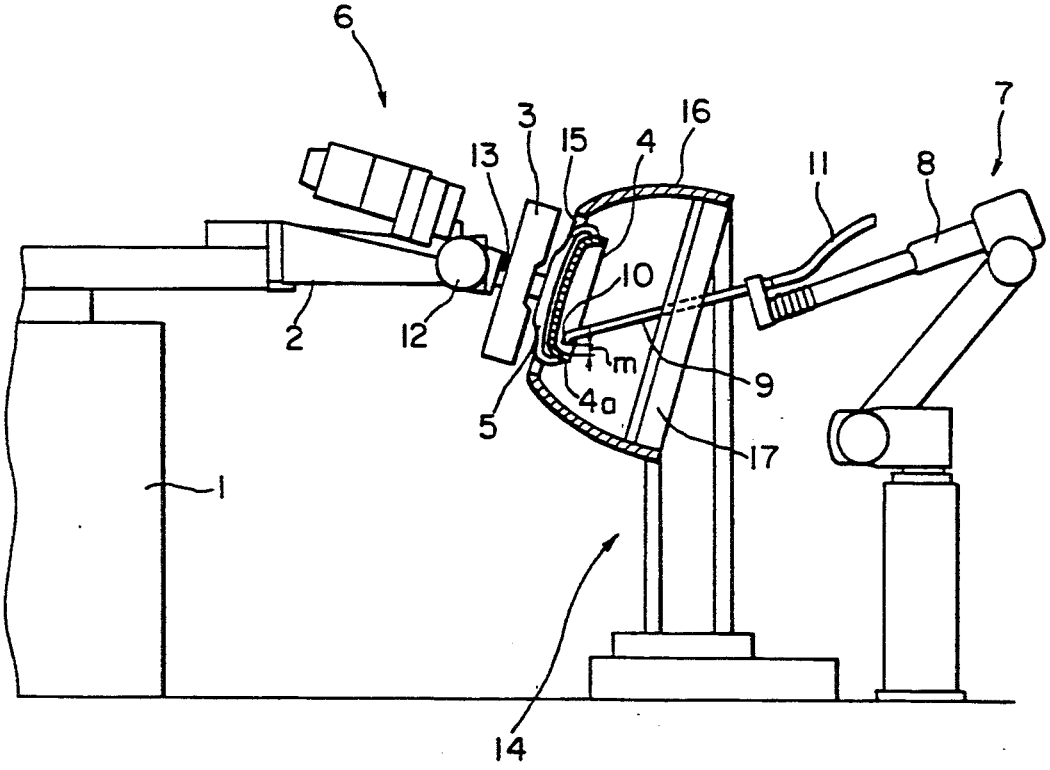
FIG. 1 is a side elevational view, partly in section, showing a cleaning apparatus of a manufacturing apparatus for use for a process of manufacturing a cathode ray tube according to the present invention.
Figure 2:
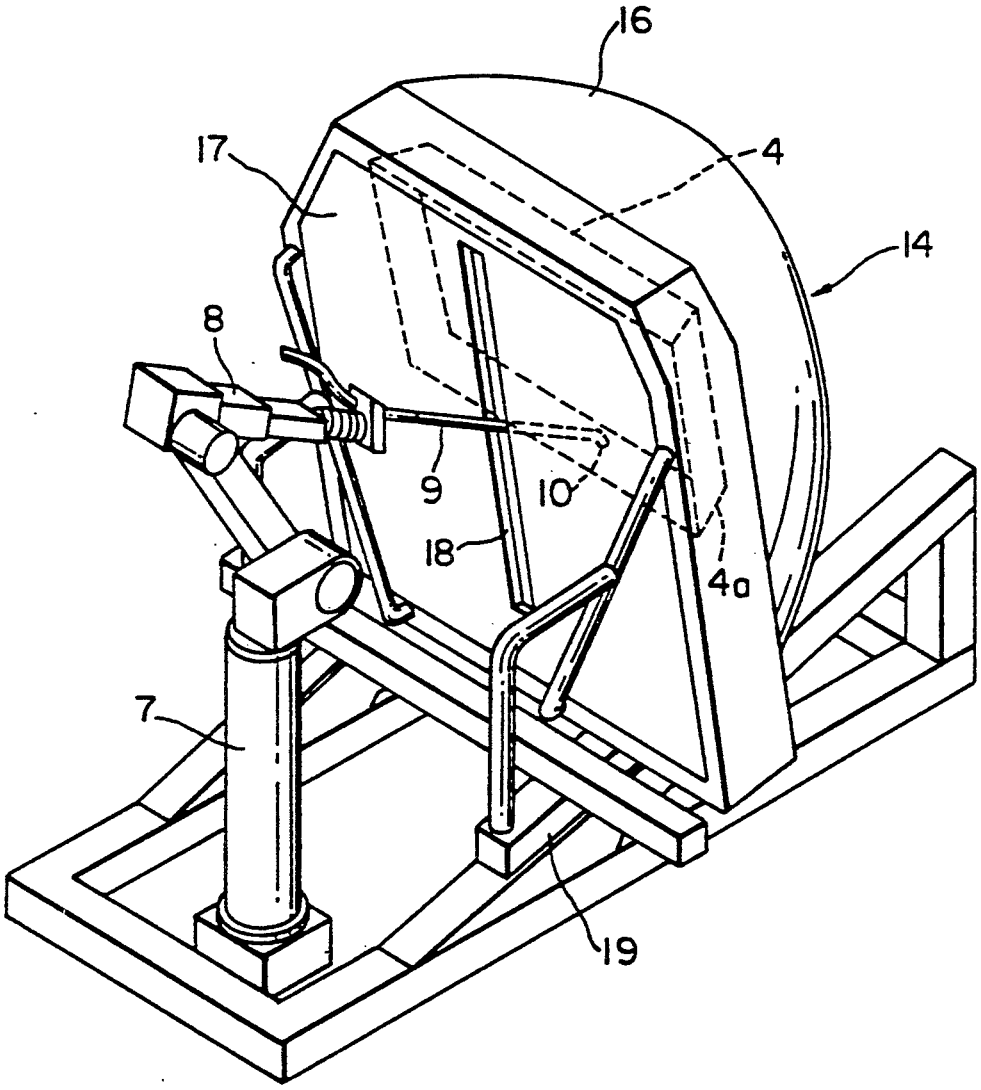
FIG. 2 is an enlarged perspective view of part of the cleaning apparatus of FIG. 1 as viewed from the rear.

Referring first to FIGS. 1 and 2, there is shown a cleaning apparatus of a manufacturing apparatus for use for a process of manufacturing a cathode ray tube according to the present invention. The cleaning apparatus shown includes a panel transporting apparatus 1, a panel rotating mechanism 6 including a head 3 mounted on an arm 2 of the panel transporting apparatus 1 and a clamp mechanism 5 mounted on a lower face of the head 3 for removably holding a panel 4 for rotation thereon, and a cleaning a liquid supplying mechanism 7 in the form of a vertical articulated 6-axis robot.

The cleaning liquid supplying mechanism 7 includes an upper arm 8 having a cleaning liquid supply pipe 9 supported at an end thereof, and a cleaning nozzle 10 is mounted at an end of the cleaning liquid supply pipe 9. A cleaning liquid supply hose 11 is connected to the other or rear end of the cleaning liquid supply pipe 9 so that cleaning liquid such as, for example, water may be fed into the cleaning liquid supply pipe 9 through the cleaning liquid supply hose 11 and then jetted from the cleaning nozzle 10.

The panel rotating mechanism 6 includes a revolutionary shaft 12 and a rotational shaft 13. A panel 4 is thus removably held by means of the revolutionary shaft 12 such that an axis thereof is inclined obliquely downwardly at an inclination angle of about 15 degrees with respect to a horizontal direction while it is rotated around its inclined axis at a rotational speed of about 6 to 10 rpm by the rotational shaft 13.

A drying mechanism 14 is installed between the panel rotating mechanism 6 and the cleaning liquid supplying mechanism 7. The drying mechanism 14 includes a heater 17 in the form of a plate disposed in an opposing relationship to a panel 4 held on the clamp mechanism 5 in a hood 16 which has an opening 15 at the front thereof. The heater 17 has a vertically extending slit 18 formed at a horizontal central portion thereof as seen in FIG. 2, and the cleaning nozzle 10 of the cleaning liquid supplying mechanism 7 extends through the slit 18 to the panel 4 side and is moved upwardly or downwardly in and along the slit 18. The drying mechanism 14 is constructed such that it is slidably moved obliquely forwardly by a known slide mechanism 19 so as to allow a panel 4 to be accommodated into the hood 16 through the opening 15.

Figure 3:
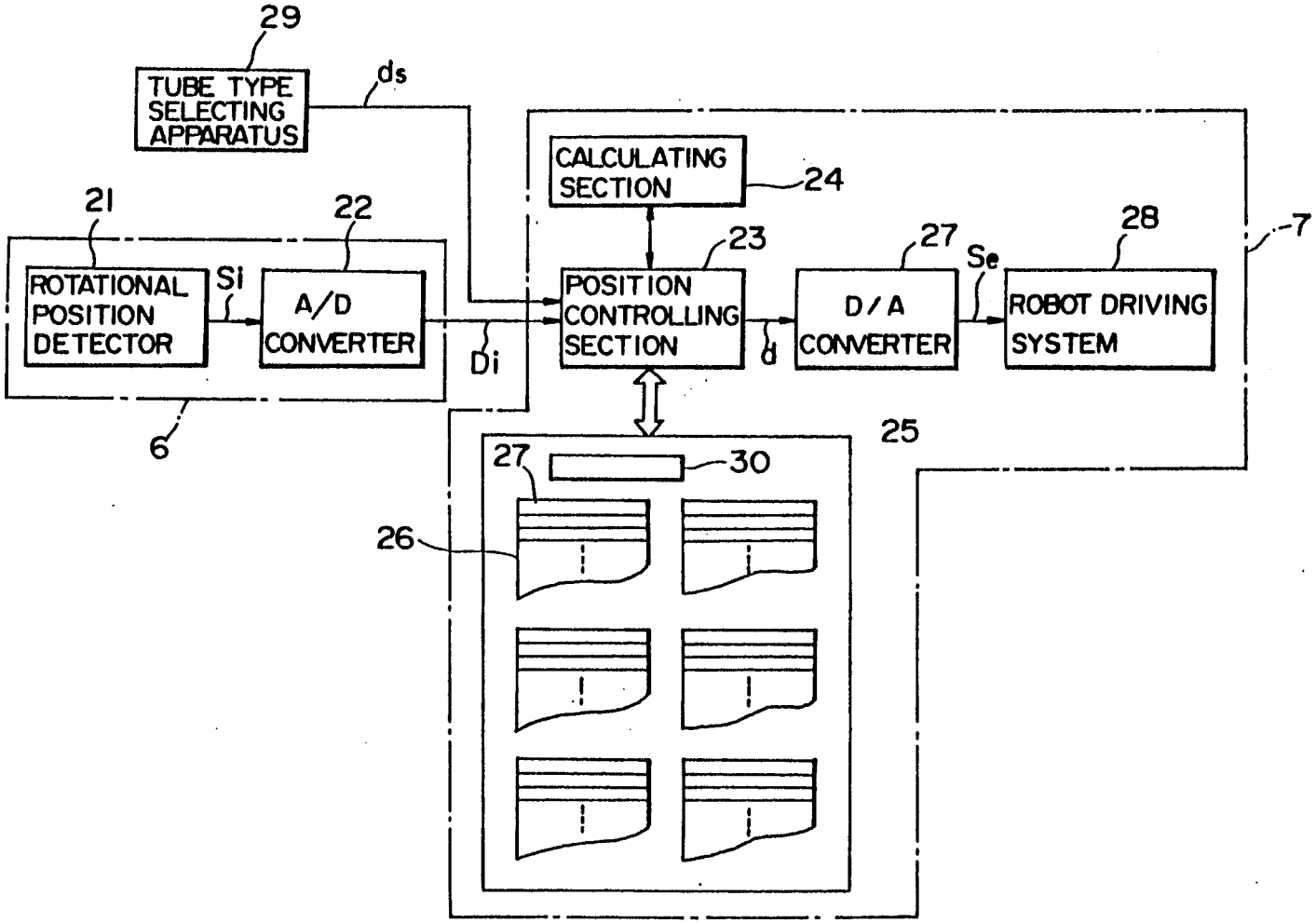
FIG. 3 is a block diagram illustrating signal processing by the cleaning apparatus of FIG. 1.

An AC servo mechanism not shown is provided on the rotational shaft 13 to control rotation of the rotational shaft 13. Such AC servo mechanism may include an AC servomotor, a rotational position detector 21 (FIG. 3), an AC servo amplifier and so forth. Referring also to FIG. 3, rotational position information Si obtained with the rotational position detector 21 of the AC servo mechanism for detecting a rotational position of the rotational shaft 13 is coded by an analog to digital converter 22, and a coded signal Di thus obtained is supplied to the cleaning liquid supplying mechanism 7. More particularly, the rotational position detector 21 detects a rotational position of the rotational shaft 13 each time the rotational shaft 13 rotates, for example, by a rotational angle of 3 degrees, and supplies such rotational position information Si to the cleaning liquid supplying mechanism 7.

The rotational position detector 21 may be formed, for example, from a potentiometer, and information regarding a rotational position in the form of a voltage obtained from the potentiometer may be converted into a digital rotational position signal Di. Or alternatively, the rotational position detector 21 and the analog to digital converter 22 may be formed, for example, using a coding disk or the like.

On the other hand, in the cleaning liquid supplying mechanism 7, a rotational position signal Di transmitted from the panel rotating mechanism 6 is received at a position controlling section 23, and a predetermined address calculation is executed in a calculating section 24 in response to such rotational position signal Di. Such address calculation is executed to calculate, for example, an address of that array variable area 27 of a distance data file 26 stored in a memory 25 which corresponds to the rotational position signal Di. Then, distance data d corresponding to the rotational position signal Di are read out from the distance data file 26 in the memory 25 in accordance with a result of such calculation and then supplied to a digital to analog converter 31 so that they are converted into a corresponding drive voltage (or current) Se. Then, the drive voltage (current) Se is supplied to a robot driving system 28 such as an actuator at the following stage to cause the cleaning nozzle 10 to move in an upward or downward direction so that the cleaning nozzle 10 may be spaced by a fixed distance m from an inner wall of a skirt portion 4a of the panel 4.

Figure 4:
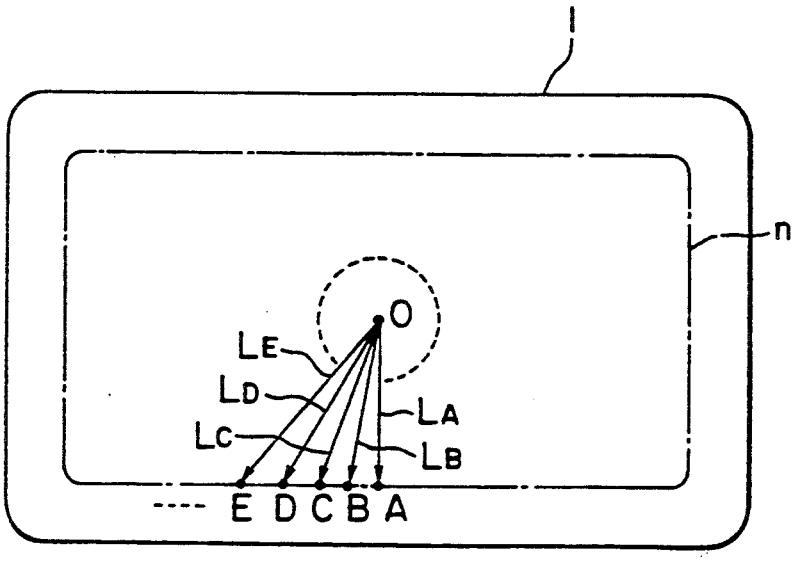
FIG. 4 is a diagrammatic representation illustrating calculation of a distance by the cleaning apparatus of FIG. 1.

Distance data d stored in the individual array variable areas 27 of the distance data file 26 can be determined in accordance, for example, with the following method. In particular, for example, as shown in FIG. 4, a cleaning nozzle locus n is first determined which is drawn in advance along an inner wall line l of a skirt portion 4a of a rotating panel 4 in a spaced relationship by a fixed distance m from an inner wall of the panel skirt portion 4a such that the distance m between the inner wall of the panel skirt portion 4a and the cleaning nozzle 10 may be kept fixed, and then the cleaning nozzle locus n is plotted at points for each predetermined rotational angle (3 degrees in the present embodiment) around a central axis O of the panel 4 and rectilinear distances between the central axis x and the individual points $L_A$, $L_B$, $L_C$, . . . are measured. In this instance, if it is assumed that the initial position of the cleaning nozzle 10 is set, for example, to the point A, distance data $d_b$ regarding the point B are provided as deviation data from that regarding the preceding point A, that is, $L_B-L_A$. Distance data $d_c$ regarding the point C are provided as deviation data from that regarding the preceding point B, that is, $L_C-L_B$. Similarly, distance data d regarding any following point are provided as deviation data from that regarding another point directly preceding to the point. Then, the distance data d thus obtained are successively stored into the distance data file 26. Such steps of operation as described above can be performed using, for example, a CAD (computer aided design) system.

Then, if the cleaning nozzle 10 is controlled to operate in accordance with the distance data d of the distance data file 26 and a rotational position signal Di supplied thereto from the panel rotating mechanism 6, then it is moved upwardly or downwardly in accordance with such cleaning nozzle locus n as shown in FIG. 4. Consequently, the distance m between the cleaning nozzle 10 and the inner wall of the skirt portion 4a of the panel 4 is kept constant.

The method described above can be applied for processing of a cathode ray tube of a different size, that is, of a different type.

Before a cathode ray tube of a different type is actually processed, distance data d of a panel of the different type having a different size are calculated in such a manner as illustrated in FIG. 4 using a CAD system and then stored into the memory 25. In this instance, such distance data d may be successively stored into different distance data files 26 for different types of different sizes as seen from FIG. 3.

Then, information of a type of cathode ray tubes to be processed subsequently is inputted by a way of a separately provided tube type selecting apparatus 29 which may be, for example, a selecting switch or switches or a keyboard. Such input data $d_s$ are supplied to the position controlling section 23 and stored, for example, into a tube type selection flag 30 in the memory 25. The input data $d_s$ stored in the tube type selection flag 30 are used as a read-out index for the distance data file 26 stored for individual tube types. Thus, a particular one of the distance data files 26 is selected in accordance with the input data $d_s$, and then an address of an array variable area 27 in the particular distance data file 26 is calculated in accordance with a rotational position signal Di transmitted thereto from the panel rotating mechanism 6 and pertaining distance data d are read out from the array variable area 27 of the address thus calculated. After then, the distance data d thus read out are converted into a drive voltage (or current) Se by the digital to analog converter 31, and the drive voltage (current) Se is supplied to the robot driving system 28 to move the cleaning nozzle 10 upwardly or downwardly in a similar manner as described above. Consequently, also with the panel 4 of the different size, the distance m between the inner wall of the skirt portion 4a of the panel 4 and the cleaning nozzle 10 can be kept constant.

As described so far, according to the embodiment of the present invention, since the position of the cleaning nozzle 10 is set in accordance with a rotational position signal Di relying upon rotation of a panel 4, trimming cleaning of an inner wall of the skirt portion 4a of the panel 4 can be performed in a non-contacting condition. As a result, the inner wall of the panel skirt portion 4a can be trimming cleaned without being influenced by a profile of an outer periphery of the panel 4 or by irregular or non-uniform rotation of the panel 4 while the distance m between the inner wall of the panel skirt portion 4a and the cleaning nozzle 10 is kept constant. Consequently, splashing of cleaning liquid which may possibly be caused by vibrations of the cleaning nozzle 10 or the like can be prevented and accurate trimming cleaning can be achieved. This will lead to improvement in quality of a fluorescent face formed subsequently on the inner face of the panel 4, and accordingly, a high yield and a high quality of cathode ray tube products can be realized.

Further, since the position of the cleaning nozzle 10 can be controlled in accordance with any given panel size as distinct from such conventional trimming cleaning method relying upon tracing of a roller by means of a link mechanism as described hereinabove, any of cathode ray tubes having comparatively high aspect ratios and cathode ray tubes having different panel sizes can be trimming cleaned successively while keeping the distance m between the inner wall of the panel skirt portion 4a and the cleaning nozzle 10 constant.

Having now fully described the invention, it will be apparent to one of ordinary skill in the art that many changes and modifications can be made thereto without departing from the spirit and scope of the invention as set forth herein.

What is claimed is:

1. In a process of manufacturing a cathode ray tube, the improvement wherein a rotational position signal is detected in response to rotation of a panel, and while the distance between a cleaning nozzle and an inner wall of a skirt portion of the panel is kept constant in response to such rotational position signal, cleaning liquid is supplied through said cleaning nozzle to clean the inner wall of the skirt portion of the panel.

2. A method of cleaning a panel in manufacture of a cathode ray tube, comprising the steps of producing, for each angular rotation of a predetermined angle of a panel of a particular type around a fixed axis, distance data of an inner wall of the panel and storing the distance data successively into a memory for one full rotational of the panel, rotating a panel of the particular type around the fixed axis, and supplying cleaning liquid through a cleaning nozzle to an inner wall of a skirt portion of the panel being rotated while maintaining the distance between the cleaning nozzle and the inner wall of the skirt portion of the panel constant in response to distance data read out from said memory in response to an angular position of the panel.

3. A method according to claim 2, wherein distance data at a given angular position of a panel are provided as a difference of a distance from the fixed axis to the inner wall of a skirt portion of the panel at the angular position of the panel from another distance from the fixed axis to the inner wall of the skirt portion of the panel at another angular position of the panel preceding by the predetermined angle to the given angular position.

4. A method according to claim 2, wherein the producing and storing step is repeated for panels of different types so that distance data of the panels of the different types may be stored into said memory, and further comprising the step of designating a particular type of a panel to be subsequently rotated and cleaned.

5. An apparatus for cleaning a panel in manufacture of a cathode ray tube, comprising:

panel rotating means for removably receiving a panel and rotating the same around a fixed axis;

a cleaning nozzle for supplying cleaning liquid to an inner wall of a skirt portion of a panel being rotated by said panel rotating means;

nozzle moving means for moving said cleaning nozzle along a particular straight line passing the fixed axis;

means for detecting a rotational position signal in response to rotation of a panel received on said panel rotating means;

distance data producing means for producing distance data each time a panel received on said panel rotating means is rotated by a predetermined angle;

storage means for storing therein distance data successively produced from said distance data producing means for one full rotation of a panel received on said panel rotating means, the distance data being stored for a particular type of the panel;

means for reading out the distance data for the particular type from said storage means in response to an angular position of a panel received on and being rotated by said panel rotating means; and controlling means for controlling said nozzle moving means to keep said cleaning nozzle, in response to the distance data read out from said storage means, at a predetermined distance along the particular straight line from the inner wall of the skirt portion of a panel of the particular type being rotated by said panel rotating means.

6. An apparatus according to claim 5, wherein said storage means is capable of storing therein distance data for different types of panels, and further comprising means for designating a particular type of a panel.

7. An apparatus according to claim 2, wherein distance data at a given angular position of a panel being rotated by said panel rotating means are provided as a difference of a distance from the fixed axis to the inner wall of the skirt portion of the panel at the angular position of the panel from another distance from the fixed axis to the inner wall of the skirt portion of the panel at another angular position of the panel preceding by the predetermined angle to the given angular position.

* * * * *